US005346800A

United States Patent [19]

Foley et al.

[11] Patent Number: 5,346,800

[45] Date of Patent: Sep. 13, 1994

[54] IMAGE-RECEIVING ELEMENT FOR DIFFUSION TRANSFER PHOTOGRAPHIC FILM PRODUCTS

[75] Inventors: James A. Foley, Wellesley; Nicholas S. Hadzekyriakides, Arlington; James J. Reardon, Winchester, all of Mass.

[73] Assignee: Polaroid Corporation, Cambridge, Mass.

[21] Appl. No.: 132,538

[22] Filed: Oct. 6, 1993

[51] Int. Cl.[5] ..... G03C 5/54; G03C 11/12; G03C 1/90

[52] U.S. Cl. ..... 430/213; 430/212; 430/215; 430/216; 430/259; 430/262; 430/263

[58] Field of Search ..... 430/215, 216, 259, 262, 430/263, 212, 213

[56] References Cited

U.S. PATENT DOCUMENTS

| | | | |
|---|---|---|---|
| 3,462,265 | 8/1969 | Land | 430/227 |
| 3,619,155 | 11/1971 | Young | 430/215 |
| 4,009,031 | 2/1977 | Carlson et al. | 430/216 |
| 4,401,746 | 8/1983 | Pfingston | 430/215 |
| 4,459,346 | 7/1984 | Bishop et al. | 430/215 |
| 4,499,174 | 2/1985 | Bishop et al. | 96/3 |
| 4,629,677 | 12/1986 | Katoh | 430/215 |
| 4,649,095 | 3/1987 | Takahashi et al. | 430/216 |
| 4,665,005 | 5/1987 | Aono et al. | 430/203 |
| 4,871,648 | 10/1989 | Bowman et al. | 430/215 |

*Primary Examiner*—Richard L. Schilling
*Attorney, Agent, or Firm*—Gaetano D. Maccarone

[57] ABSTRACT

An image-receiving element for use in photographic diffusion transfer film units of the type wherein the image-receiving element, which includes an image-receiving layer, is designed to be removed, or "peeled-apart", from a photosensitive element after exposure and development have been carried out. The image-receiving element includes a strip-coat layer comprising a hydrophilic colloid, such as gum arabic, and an aluminum salt which overlies the image-receiving layer and significantly reduces striations and/or haze and facilitates the separation of the image-receiving element from the remainder of the film unit subsequent to diffusion transfer photography.

12 Claims, 1 Drawing Sheet

IMAGE-RECEIVING ELEMENT FOR DIFFUSION TRANSFER PHOTOGRAPHIC FILM PRODUCTS

BACKGROUND OF THE INVENTION

This invention relates to an image-receiving element for use in photographic film units of the diffusion transfer type. More particularly, the invention relates to an image-receiving element especially adapted for use in diffusion transfer photographic film units of the type wherein an image-receiving element is designed to be separated from a photosensitive element after exposure and photographic processing have been effected.

Photographic film units of the diffusion transfer type, including those of the aforementioned "peel-apart" type, are well known in the art and have been described in numerous patents. Exemplary of these are U.S. Pat. Nos. 2,983,606; 3,345,163; 3,362,819; 3,594,164; and 3,594,165. In general, diffusion transfer photographic products and processes involve film units having a photosensitive system including at least one silver halide layer, usually integrated with an image-providing material, e.g., an image dye-providing material. After photoexposure, the photosensitive system is developed, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the so-called "peel-apart" type, the image is viewed in the image-receiving layer upon separation of the image-receiving element from the photosensitive element after a suitable imbibition period. In other products, such separation is not required.

Image-receiving elements particularly adapted for use in "peel-apart" diffusion transfer film units have typically embodied an image-receiving layer for retaining the transferred image arranged on a substrate layer of suitable material or a combination of layers arranged on the substrate layer, each of the layers providing specific and desired functions adapted to the formation of the desired photographic image in accordance with diffusion transfer processing. Thus, in one well known embodiment the image-receiving element typically comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such preferred structure is described, for example, in the aforementioned U.S. Pat. No. 3,362,819 and is illustrated in other patents, including U.S. Pat. Nos. 4,322,489 and 4,547,451.

It is known in the art to utilize a stripping layer in such image-receiving elements to facilitate the separation of the image-receiving layer from the photosensitive element after photographic processing. U.S. Pat. No. 4,009,031 discloses and claims an image-receiving element of this type wherein the stripping layer is formed by coating the image-receiving layer with an aqueous solution of a hydrophilic colloid, such as gum arabic, and ammonia. Such stripping layers have proved to be very effective for their intended purpose. However, in some instances, particularly when the image-receiving element and photosensitive element are peeled-apart relatively slowly, striations may occur on the surface of the image-receiving element. These are thought to be due to some of the stripping layer material remaining on the image-receiving layer after separation and may adversely affect the desired quality of the photograph.

It would be very desirable to provide image-receiving elements wherein such striations can be significantly reduced or eliminated.

SUMMARY OF THE INVENTION

The present invention provides an image-receiving element which includes a strip-coat layer comprising a hydrophilic colloid such as gum arabic and an aluminum salt overlying the image-receiving layer. It has been found that the strip coat layer formed in accordance with the invention facilitates separation of the image-receiving element from contact with the diffusion transfer processing composition and the photosensitive element subsequent to diffusion transfer photographic processing thereby significantly reducing or eliminating any observable striations on the resulting photograph even when the respective elements are peeled apart relatively slowly.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

Figure 1:
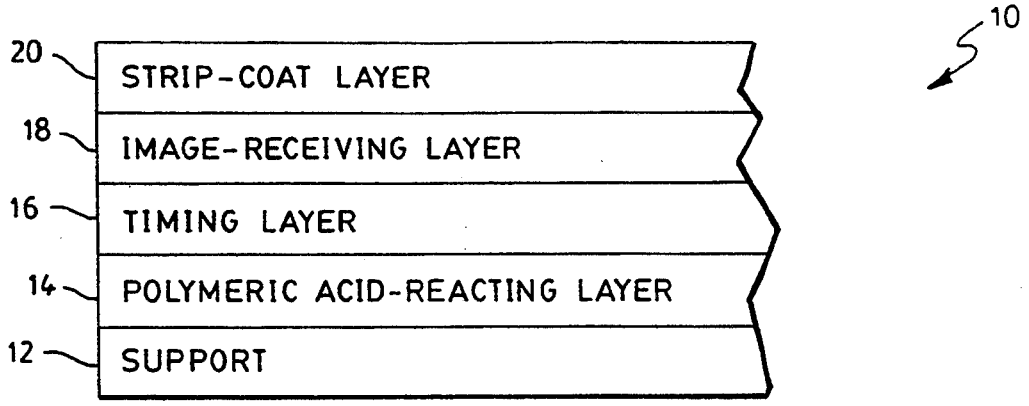
FIG. 1 is a partially schematic, cross-sectional view of one embodiment of an image-receiving element according to the invention.

Referring now to FIG. 1 there is seen an image-receiving element 10 according to the invention comprising a support layer 12 carrying a polymeric acid-reacting layer 14, a timing (or spacer) layer 16, an image-receiving layer 18 and a strip-coat layer 20. Each of the layers carried by support layer 12 functions in a predetermined manner to provide desired diffusion transfer processing and is described in detail hereinafter.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulosic derivatives such as cellulose acetate, cellulose triacetate or cellulose acetate-butyrate, can be suitably employed. Depending upon the desired nature of the finished photograph, the nature of support material 12 as a transparent, opaque or translucent material will be a matter of choice. Typically, an image-receiving element of the present invention, adapted to be used in so-called "peel-apart" diffusion transfer film units and designed to be separated after processing, will be based upon an opaque support material 12. As illustrated in the film unit of FIG. 2 (which shows the film unit after photographic processing and prior to the separation of image-receiving element 10*a* from the processed photosensitive element 30*b*), support 12 can comprise an opaque support material 12*a*, such as paper, carrying a light-reflecting layer 12*b*. On separation of the image-bearing photograph 10*a*, the image in layer 18*a* can be viewed against light-reflecting layer 12*b*. Light-reflecting layer 12*b* can comprise, for example, a polymeric matrix containing a suitable white pigment material, e.g., titanium dioxide.

While support material 12 of image-receiving element 10 will preferably be an opaque material for production of a photographic reflection print, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development. Upon processing and removal of the opaque pressure-sensitive sheet, the photographic image diffused into image-receiving layer 18 can be viewed as a transparency. In another embodiment where support material 12 is a transparent sheet, opacification materials such as carbon black and titanium dioxide may be incorporated in the processing composition to permit in-light development.

Figure 2:
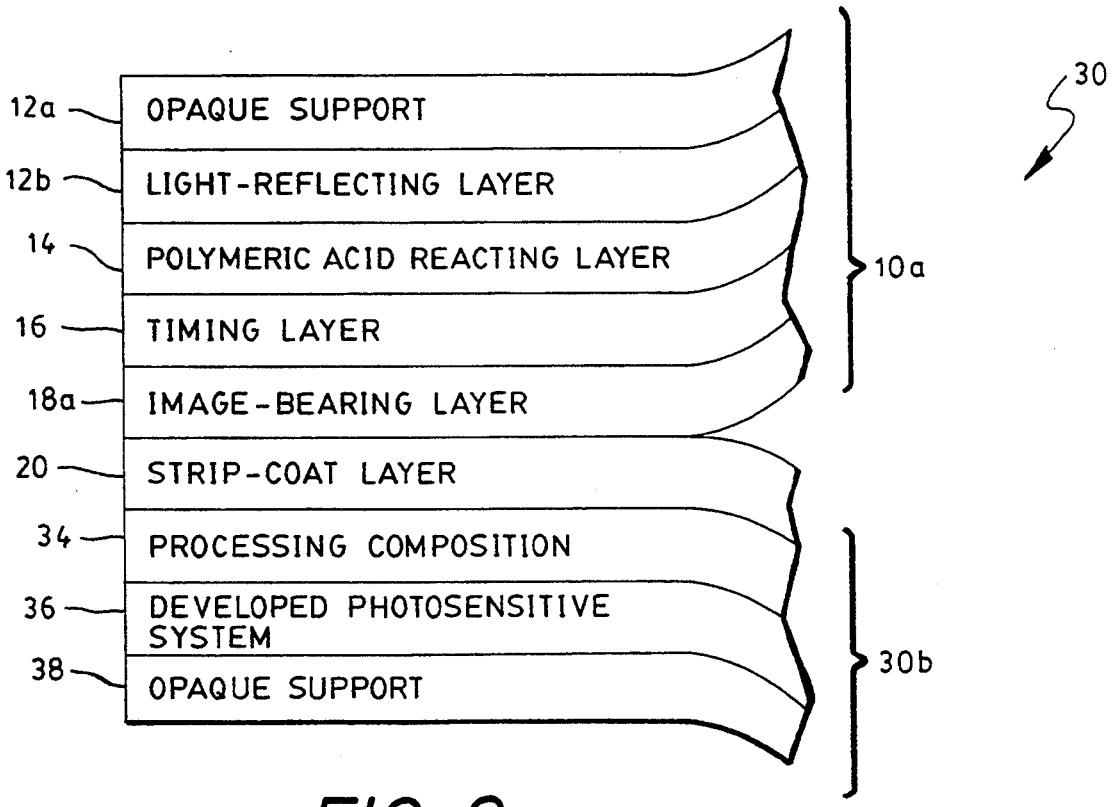
FIG. 2 is a partially schematic, cross-sectional view of a photographic film unit according to the invention, shown after exposure and processing.

On the embodiment illustrated, in FIGS. 1 and 2, image-receiving element 10 includes a polymeric acid-reacting layer 14. Polymeric acid-reacting layer 14 serves an important function in reducing the environmental pH of the film unit, subsequent to transfer image formation, to a pH at which the residual image dye-providing material remaining within the photosensitive structure is rendered non-diffusible. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image dyes are diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and partial esters of polyethylene/maleic anhydride copolymers.

Polymeric acid-reacting layer 14 can be applied, if desired, by coating support layer 12 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water soluble polymeric acid and a water soluble matrix, or binder, material. Suitable water-soluble polymeric acids include ethylene/maleic anhydride copolymers and poly(-methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in the following U.S. Pat. Nos.: 3,765,885; 3,819,371; 3,833,367 and 3,754,910.

Timing layer 16 controls the initiation and the rate of capture of alkali by the acid-reacting polymer layer 14. As indicated previously, timing layer 16 serves as an alkali impermeable barrier for a predetermined time interval before converting in a rapid and quantitatively substantial fashion to a relatively alkali permeable condition, upon the occurrence of a predetermined chemical reaction. Timing layer 16 can be provided by resort to polymeric materials which are known in the diffusion transfer art and which are described, for example, in U.S. Pat. Nos. 4,201,587; 4,288,523; 4,297,431; 4,391,895; 4,426,481; 4,458,001; 4,461,824 and 4,547,451. As described in these patents, timing layers having the aforedescribed characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 16 will typically be copolymers comprising repeating units of the aforedescribed type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which timing layer 16 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 16 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymer to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 16, thereby altering the time necessary for initiation of the desired and predetermined chemical reaction. This latter means of adjusting the hold time of timing layer 16 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 16 and, thus, a longer hold time, may be obtained by increasing the hydrophobicity of the matrix polymer or increasing the degree of coalescence.

Examples of suitable comonomers which can be used in the production of copolymeric materials suited to application in timing layer 16 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl)acrylamide, N-(β-dimethylaminoethyl)acrylamide; N-(t-butyl)acrylamide; N-[β-(dimethylamino)ethyl]methacrylamide; 2-[2'-acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'-methyl butyramido]acetamide; and diacetone acrylamide.

Matrix polymer systems adapted to utilization in timing layer 16 can be prepared by physical mixing of the matrix polymer and the polymer containing the repeating units capable of undergoing alkali-initiated chemical reaction, or by the preparation of the timing layer polymer in the presence of a preformed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 16 of polymer or other materials which adversely affect or negate the desired alkali impermeable barrier properties of timing layer 16 is to be avoided. In this connection, it should be noted that gelatin, and particularly unhardened gelatin, is readily swollen and permeated by aqueous alkaline compositions typically employed in photographic processing. Accordingly, the presence in a timing layer of amounts of gelatin or other materials which promote rapid permeation of the layer by alkali and which effectively negate the hold character of the layer are to be avoided. Timing layer 16 is typically applied as a water-impermeable layer which results from the coalescence and drying of a coating composition, e.g., a latex composition.

The image-receiving layer 18 generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas. A preferred image-receiving layer material comprises a graff copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. A preferred hydrazinium mordant is poly(1-vinylbenzyl 1,1-dimethylhydrazinium chloride) which, for example, can be admixed with polyvinyl alcohol for provision of a suitable image-receiving layer.

Strip-coat layer 20 comprises a mixture of a hydrophilic colloid and an aluminum salt. The thickness of the strip-coat layer 20 may vary and preferably is quite thin, i.e., from about 0.01 to about 0.05 mils. It is apparent that the strip-coat layer 20 should not contain a mordant for the diffusing image dye-providing material and should not be so thick as to serve as an image-receiving layer itself, or interfere with the transfer of the image dye-providing material to the underlying image dye-receiving layer 18. Generally, a strip-coat layer having a total coverage of from about 5 mgs/ft$^2$ (54 mgs/m$^2$) to about 100 mgs/ft$^2$ (1,076 mgs/m$^2$) can provide the desired results.

A wide variety of hydrophilic colloids are contemplated as being suitable for forming the overcoat layer of the present invention. Preferred hydrophilic colloids are those providing effective "strip coats" for diffusion transfer image-receiving elements which require separation, subsequent to formation of a transfer image, from the viscous processing composition. As specific examples of such hydrophilic colloids, mention may be made of gum arabic, polyethylene glycol, carboxymethyl cellulose, hydroxyethyl cellulose, carboxymethyl hydroxyethyl cellulose, cellulose acetate-hydrogen phthalate, polyvinyl alcohol, polyvinyl pyrrolidone, methyl cellulose, ethyl cellulose, cellulose nitrate, sodium alginate, pectin, polymethacrylic acid, polymerized salts of alkyl, aryl and alkyl sulfonic acids (e.g., Daxad, W. R. Grace Co.), and the like. A preferred hydrophilic colloid material is gum arabic.

Any suitable aluminum salt may be incorporated into the strip-coat layer 20. Typical suitable aluminum salts include aluminum acetate, aluminum chloride, aluminum lactate and the like. Aluminum lactate is preferred.

The aluminum salt may be present in any effective amount. In the preferred embodiment wherein the hydrophilic colloid is gum arabic and the aluminum salt is aluminum lactate, the preferred range of these components is from about 2:1 to about 6:1 (by weight).

It should be noted here that the aluminum salt should remain in solution during coating of the strip coat layer. In the preferred embodiment wherein the hydrophilic colloid is gum arabic, it is preferred to coat the strip-coat layer from a solution which contains ammonium hydroxide as is taught in U.S. Pat. No. 4,009,031. This preferred solution may be coated from an aqueous coating solution prepared by diluting concentrated ammonium hydroxide with water to the desired concentration, preferably from about 2% to about 8% by weight and then adding to this solution an aqueous hydrophilic colloid solution having a total solids concentration in the range of from about 1% to about 5% by weight. The coating solution may also preferably include a small amount of a surfactant, for example, less than about 0.10% by weight of Triton X-100 (Rohm & Haas Co.). Aluminum lactate is the preferred aluminum salt in the embodiment where the strip-coat layer is coated from a composition containing ammonium hydroxide since aluminum lactate does not precipitate from solution at the elevated pH caused by the presence of the ammonium hydroxide The strip-coat layer described above may be incorporated in various types of image-receiving elements known in the art and the materials and the arrangement and order of the individual layers in such elements may vary. A particularly preferred image-receiving element according to the invention also includes a layer comprising silica particles together with one or more materials, the layer being arranged between the image-receiving layer 18 and the strip-coat layer 20. This layer reduces the time period for which the image-receiving element remains wet and sticky after the image-receiving element has been separated from the photosensitive element. An image-receiving element which includes such a layer is disclosed and claimed in commonly-assigned, copending application Ser. No. 08/132,534, of Kenneth C. Waterman, filed concurrently herewith. When the strip-coat layer of the present invention is coated over the silica layer, the resulting photograph typically has a more glossy surface than would otherwise be the case.

The image-receiving elements of the present invention are especially adapted to utilization in film units intended to provide multicolor dye images. The image-receiving elements can be processed with a photosensitive element and a processing composition as illustrated in FIG. 2. The most commonly employed negative components for forming multicolor images are of the "tripack" structure and contain blue-, green-, and red-sensitive silver halide layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,740,448 to P. O. Kliem.

As is illustrated in FIG. 2, the strip-coat layer 20 is intended to be removed cleanly and completely from the image-receiving element 10*a* during separation of that element from the processing composition and the photosensitive element (collectively 30*b*). It has been found that the strip-coat layer of the invention is separated cleanly and completely from image-bearing layer 18*a* during separation of elements 10*a* and 30*b*, thus eliminating undesirable striations in the developed photograph.

Although the image-receiving layer of the invention has been described in detail with respect to the preferred embodiment illustrated in FIG. 1, it should be noted that the strip-coat layer according to the invention may be used in conjunction with any image-receiving element used in diffusion transfer photographic film units. The diffusion transfer photographic film unit described in Japanese patent application 561-252685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. A strip-coat layer according to the present invention can be arranged between the image-receiving layer and the peelable layer of this type of diffusion transfer film unit.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

An image-receiving element was prepared comprising the following layers coated in succession on a white-pigmented polyethylene coated opaque support:

1. a polymeric acid-reacting layer, at a coverage of about 2,390 mgs/ft$^2$ (about 25,726 mgs/m$^2$), comprising 9 parts Gantrez S-97 (from GAF Corp.), a free acid of a copolymer of methyl vinyl ether and maleic anhydride and 11 parts Airflex 465 (Air Products Co.) vinyl acetate ethylene latex;

2. a timing layer coated at a coverage of about 250 mgs/ft$^2$ (about 2,691 mgs/m$^2$) comprising a copolymer of diacetone acrylamide and acrylamide grafted onto polyvinyl alcohol;

3. a hold-release timing layer coated at a coverage of about 235 mgs/ft$^2$ (about 2,529 mgs/m$^2$) comprising a copolymer of diacetone acrylamide/butyl acrylate/carboxymethoxymethyl acrylate/methacrylic acid;

4. an image-receiving layer coated at a coverage of about 300 mgs/ft$^2$ (about 3,229 mgs/m$^2$) of a graft copolymer comprising 4-vinyl pyridine (4VP) and vinyl benzyl trimethylammonium chloride (TMQ) grafted onto hydroxyethylcellulose (HEC);

5. a strip coat layer coated at a coverage of about 86 mgs/ft$^2$ (about 926 mgs/m$^2$) of gum arabic.

This image-receiving element was used as a means of establishing a comparative evaluation with image-receiving elements according to the invention and is identified herein as CONTROL-I.

EXAMPLE II

Image-receiving elements (A) according to the invention were prepared which were the same as CONTROL-I with the exception that they included a strip-coat layer comprising about 60 mgs/ft$^2$ (about 646 mgs/m$^2$) of gum arabic and about 35 mgs/ft$^2$ (about 377 mgs/m$^2$) of aluminum lactate. The strip-coat layer was coated from a coating solution containing ammonium hydroxide as previously described.

EXAMPLE III

The image-receiving elements of Examples I and II were evaluated in photographic film units of the "peel-apart" type in the following manner:

A photosensitive element was utilized for the processing and evaluation of each of the image-receiving elements. The photosensitive element comprised an opaque subcoated polyethylene terephthalate photographic film base having the following layers coated thereon in succession:

1. a layer of sodium cellulose sulfate coated at a coverage of about 25 mgs/m$^2$;

2. a cyan dye developer layer comprising about 960 mgs/m$^2$ of the cyan dye developer represented by the formula

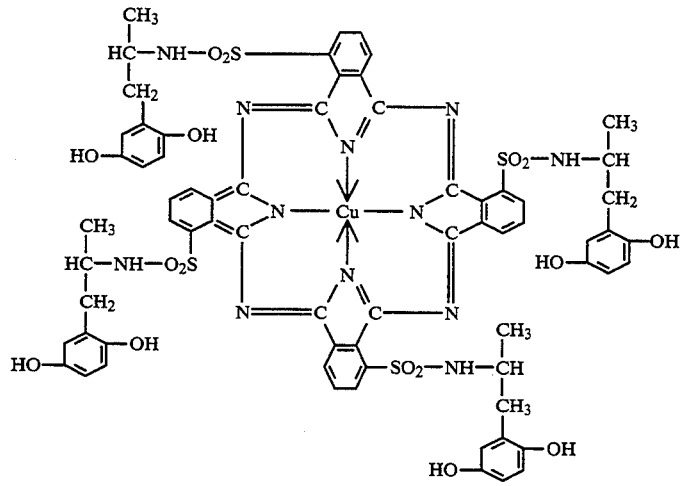

about 540 mgs/m$^2$ of gelatin and about 245 mgs/m$^2$ of phenyl norbornenyl hydroquinone (PNEHQ);

3. a red-sensitive silver iodobromide layer comprising about 780 mgs/m$^2$ of silver (0.6 micron), about 420 mgs/m$^2$ of silver (1.5 microns) and about 660 mgs/m$^2$ of gelatin;

4. an interlayer comprising about 2,325 mgs/m$^2$ of a copolymer of butyl acrylate/diacetone acrylamide/methacrylic acid/styrene/acrylic acid, about 97 mgs/m$^2$ of polyacrylamide, about 124 mgs/m$^2$ of dantoin and about 3 mgs/m$^2$ of succindialdehyde;

5. a magenta dye developer layer comprising about 455 mgs/m$^2$ of a magenta dye developer represented by the formula

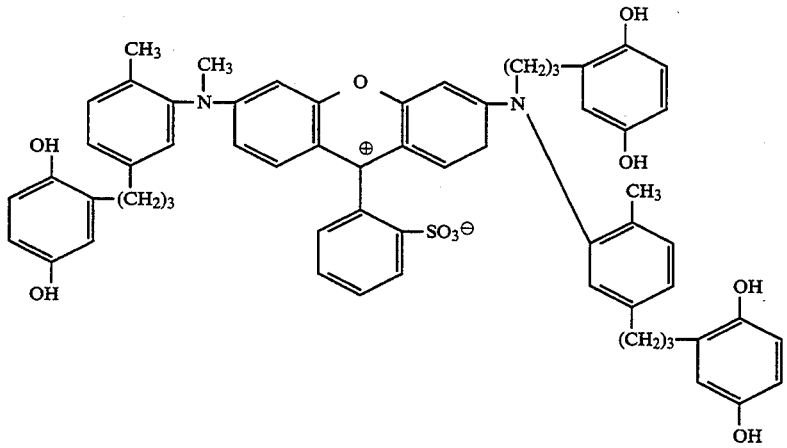

about 240 mgs/m$^2$ of gelatin and about 234 mgs/m$^2$ of 2-phenyl benzimidazole;

6. a spacer layer comprising about 250 mgs/m$^2$ of carboxylated styrenebutadiene latex (Dow 620 latex) and about 83 mgs/m$^2$of gelatin;

7. a green-sensitive silver iodobromide layer comprising about 540 mgs/m$^2$ of silver (0.6 micron), about 360 mgs/m$^2$ of silver (1.3 microns) and about 396 mgs/m$^2$ of gelatin;

8. a layer comprising about 263 mgs/m$^2$ of PNEHQ and about 116 mgs/m$^2$ of gelatin;

9. an interlayer comprising about 1,448 mgs/m$^2$ of the copolymer described in layer 4 and about 76 mgs/m$^2$ of polyacrylamide and about 4 mgs/m$^2$ of succindialdehyde;

10. a layer comprising about 1,000 mgs/m$^2$ of a scavenger, 1-octadecyl-4,4-dimethyl-2-[2-hydroxy-5-(N-(7-caprolactamido)sulfonamido]thiazolidine and about 416 mgs/m$^2$ of gelatin;

11. a yellow filter layer comprising about 241 mgs/m$^2$ of benzidine yellow dye and about 120 mgs/m$^2$ of gelatin;

12. a yellow image dye-providing layer comprising about 1,257 mgs/m$^2$ of a yellow image dye-providing material represented by the formula

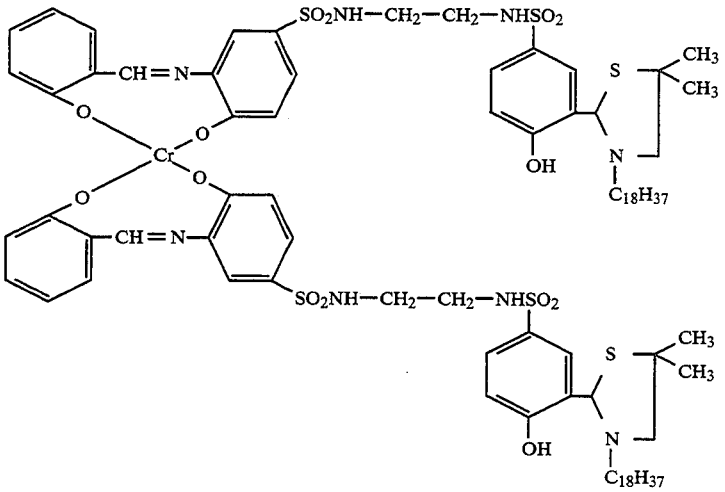

and about 503 mgs/m$^2$ of gelatin;

13. a blue-sensitive silver iodobromide layer comprising about 37 mgs/m$^2$ of silver (1.3 microns), about 208 mgs/m$^2$ of silver (1.6 microns), and about 108 mgs/m$^2$ of gelatin;

14. about 450 mgs/m$^2$ of phenyl tertiarybutyl hydroquinone, about 150 mgs/m$^2$ of 5-t-butyl-2,3-bis[(1-phenyl-1H-tetrazol-5-yl) thio]-1,4-benzenediol bis[(2-methanesulfonylethyl)carbamate]; and about 250 mgs/m$^2$ of gelatin;

15. a layer comprising about 500 mgs/m$^2$ of an ultraviolet filter, Tinuvin (Ciba-Geigy), about 190 mgs/m$^2$ of benzidine yellow dye and about 345 mgs/m$^2$ of gelatin; and 16. a layer comprising about 300 mgs/m$^2$ of gelatin.

Film units were prepared utilizing each of the receiving elements of Examples I and II and the above-described photosensitive element. In each case, after photoexposure of the photosensitive element, the image-receiving element and the photosensitive element were arranged in face-to-face relationship, i.e., with their respective supports outermost, and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The composition of the aqueous alkaline processing composition utilized for the processing of each film unit is set forth in Table I.

TABLE I

| Processing Composition | |
|---|---|
| Component | Parts by Weight |
| Potassium hydroxide | 5.1 |
| 1-(4-hydroxyphenyl)-1H-tetrazole-5-thiol | 0.004 |
| N-butyl-α-picolinium bromide | 1.8 |
| 1-methylimidazole | 0.25 |
| 1,2,4-triazole | 0.606 |
| hypoxanthine | 1.03 |
| 3,5-dimethylpyrrazole | 0.418 |
| sodium hydroxide | 1.28 |
| 2-(methylamino)ethanol | 0.25 |
| Guanine | 0.125 |
| Aluminum hydroxide hydrate | 0.24 |
| 5-amino-1-pentanol | 0.5 |
| Hydroxyethylcellulose | 2.86 |
| Chlorobenzenesulfinate | 1.0 |
| Titanium dioxide | 0.17 |
| Water | Balance to 100 |

Each film unit was subjected to exposure (2 mcs) to a standard photographic sensitometric target and was processed at room temperature (about 20° C.) by spreading the processing composition between the image-receiving and photosensitive elements as they were brought into superposed relationship between a pair of pressure rollers having a gap of about 0.0036". After an imbibition period of about 90 seconds, the image-receiving element was separated from the remainder of the film unit to reveal the image.

The time period for separating the image-receiving element from the photosensitive element was varied. Experiments were conducted where the respective time periods were: 0.4, 0.6, 1.0 and 1.5 seconds. For the CONTROL-I image-receiving elements there was observed a non-uniform deposit of the strip-coat material remaining on the image-receiving layer. Further, in each case, striations were visible on the image-receiving layer. For the image-receiving elements of the invention, no deposits were observed on the image-receiving layer, and no striations were observed.

EXAMPLE IV

Image-receiving elements according to the invention were prepared which were the same as that described in Example II except that the amounts of gum arabic and aluminum lactate in the strip-coat layer were varied as follows:

Image-Receiving Element Gum Arabic/Aluminum Lactate

| Image-Receiving Element | Gum Arabic/Aluminum Lactate |
|---|---|
| B | 85:35 |
| C | 50:30 |

These image-receiving elements were evaluated in photographic film units as described in Example Ill and the time period for separating the image-receiving element from the photosensitive element was varied as in Example III. For image-receiving elements B and C, no deposits were observed on the image-receiving layer, and no striations were observed.

EXAMPLE V

An image-receiving element was prepared which was the same as that described in Example I with the exception that the element further included, between the image-receiving layer and the gum arabic strip-coat layer, a layer comprising a 7.2/1.0/1.67 (weight ratio) of colloidal silica particles (Nyacol 1040LS), a polytetrafluoroethylene sol (Hostafion TF5032 from Hoechst) and an acrylate copolymer (Neocryl BT24 from Zeneca Resins) coated at a coverage of about 150 mgs/ft$^2$ (about 1,615 mgs/m$^2$). These elements were identified as CONTROL II.

EXAMPLE VI

Image-receiving elements (D) according to the invention were prepared which were the same as those described in Example V with the exception that the strip-coat layer was a 60/35 mixture of gum arabic and aluminum lactate.

EXAMPLE VII

The image-receiving elements of Examples V and VI were evaluated in photographic film units as described in Example Ill and the time period for separating the image-receiving element from the photosensitive element was varied as described therein. For the CONTROL-II image-receiving elements there was observed a non-uniform deposit of the strip-coat material remaining on the silica-polytetrafluoroethylene-acrylate copolymer layer, and in each case striations were visible on that layer. For image-receiving elements D of the invention, no deposits and no striations were observed.

A CONTROL-II image-receiving element and an image-receiving element D according to the invention were also measured in a Gardner Glossgard II 60° glossmeter which was calibrated against internal standards. The CONTROL-II element gave a reading of 64 in the Dmax area and 45 in the Drain area. Image-receiving element D gave a reading of 83 in the Dmax area and 70 in the Dmin area. The increase in the readings obtained for image-receiving element D was proportional to the increase in gloss due to the complete removal of the strip-coat material from the silica-containing interlayer.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. An image-receiving element for use in a photographic diffusion transfer color process which comprises, in sequence:

a support;

an image-receiving layer; and a strip-coat layer overlying said image-receiving layer, said strip-coat layer comprising a mixture of a hydrophilic colloid and an aluminum salt.

2. The image-receiving element as defined in claim 1 wherein said hydrophilic colloid is gum arabic.

3. The image-receiving layer as defined in claim 2 wherein said aluminum salt is aluminum lactate.

4. The image-receiving element as defined in claim 3 wherein said strip-coat layer comprises from about 2:1 to about 6:1 parts by weight of gum arabic and aluminum lactate.

5. The image-receiving element as defined in claim 1 wherein said strip-coat layer is coated at a coverage of from about 5 mgs/ft$^2$ to about 100 mgs/ft$^2$ of total solids.

6. The image-receiving element as defined in claim 1 wherein said image-receiving layer comprises a graft copolymer of 4-vinylpyridine and vinyl benzyl trimethylammonium chloride grafted onto hydroxyethylcellulose.

7. A photographic product for forming a diffusion transfer dye image which comprises, in combination:

a photosensitive element comprising a support which carries at least one silver halide emulsion layer associated with an image dye-providing material;

an image-receiving element comprising a support carrying an image-receiving layer and a strip-coat layer, said strip-coat layer overlying said image-receiving layer and comprising a mixture of a hydrophilic colloid and an aluminum salt; and means providing an aqueous alkaline processing composition for initiating development of said silver halide emulsion after photoexposure to form in said image-receiving layer a dye image.

8. The product as defined in claim 7 wherein said hydrophilic colloid is gum arabic.

9. The product as defined in claim 8 wherein said aluminum salt is aluminum lactate.

10. The product as defined in claim 9 wherein said strip-coat layer comprises from about 2:1 to about 6:1 parts by weight of gum arabic and aluminum lactate.

11. The product as defined in claim 7 wherein said photosensitive element comprises a cyan image dye-providing material in association with a red-sensitive silver halide emulsion layer, a magenta image dye-providing material in association with a green-sensitive silver halide emulsion layer and a yellow image dye-providing material in association with a blue-sensitive silver halide emulsion layer.

12. The product as defined in claim 7 wherein said image-receiving layer comprises a graff copolymer of 4-vinylpyridine and vinyl benzyl trimethylammonium chloride grafted onto hydroxyethyl cellulose.

* * * * *